US008540198B2

(12) United States Patent
Keyvanloo

(10) Patent No.: US 8,540,198 B2
(45) Date of Patent: Sep. 24, 2013

(54) SUPPORT ARM SYSTEM

(75) Inventor: Aydin Keyvanloo, Doncaster (AU)
(73) Assignees: Andreas Klaus Gesswein, Rinteln (DE); Liang Tung, Taipei (TW)

( * ) Notice: Subject to any disclaimer, the term of this patent is extended or adjusted under 35 U.S.C. 154(b) by 708 days.

(21) Appl. No.: 12/532,053

(22) PCT Filed: Mar. 20, 2008

(86) PCT No.: PCT/AU2008/000408

§ 371 (c)(1),
(2), (4) Date: Sep. 18, 2009

(87) PCT Pub. No.: WO2008/116255

PCT Pub. Date: Oct. 2, 2008

(65) Prior Publication Data

US 2010/0102186 A1 Apr. 29, 2010

(30) Foreign Application Priority Data

Mar. 23, 2007 (AU) ..... 2007901557
Mar. 23, 2007 (AU) ..... 2007901558

(51) Int. Cl.

| | |
|---|---|
| ***A47B 96/00*** | (2006.01) |
| ***A47K 1/00*** | (2006.01) |
| ***A47K 5/00*** | (2006.01) |
| ***E04G 5/06*** | (2006.01) |
| ***F16L 3/08*** | (2006.01) |
| ***F21V 21/00*** | (2006.01) |
| ***F21V 35/00*** | (2006.01) |

(52) U.S. Cl.
USPC ..... 248/222.51; 248/220.21; 248/220.22; 248/222.11; 248/224.8; 248/225.21; 248/222.13; 248/223.41; 248/224.7; 248/231.9

(58) Field of Classification Search
USPC ..... 248/629, 220.21, 220.22, 222.11, 248/224.8, 225.21, 221.11, 222.13, 222.51, 248/223.41, 224.7, 231.9, 220.31, 222.52, 248/222.41; 211/57.1, 59.1, 193, 87.01; 403/166, 403/304, 359.4, 353, 348, 349
See application file for complete search history.

(56) References Cited

U.S. PATENT DOCUMENTS 2,516,907 A * 8/1950 Penfold ..... 285/7
2,859,840 A * 11/1958 Fantle ..... 52/38

(Continued)

FOREIGN PATENT DOCUMENTS

DE 23 35 165 1/1975
DE 299 21 495 5/2000

(Continued)

OTHER PUBLICATIONS

European Extended Search Report dated Jul. 13, 2011 for Application No. PCT/AU2008/000408.

(Continued)

*Primary Examiner* — Terrell McKinnon
*Assistant Examiner* — Michael McDuffie
(74) *Attorney, Agent, or Firm* — Frost Brown Todd LLC

(57) ABSTRACT

A support arm system (10) includes a socket (16) for attachment to a surface (18) and a support arm (14), for removable insertion in the socket (16). The support arm (14) has at least one formation (22). The socket (16) includes a housing (28) having an insertion opening (30) leading to a passage (32) for insertion of the support arm (14). At least one formation (34) in the passage (32) complementary to the at least one formation (22) on the support arm (14) is provided to engage the support arm (14) when the support arm (14) is in the socket (16). A gate element (36) in the passage (32) is biased to a position at or in front of said at least one formation (34) in the passage. To insert the support arm (14), the gate element (36) must be pushed against its bias to expose the formation in the passage for engagement by the support arm (14) to retain the support arm in the socket, the gate element (36) providing a positive force between the support arm (14) and socket (16) while it is so retained. In another form of the invention, a gate element (126) is moveable in the housing and has a periphery complementary to the insertion opening. This gate element (126) is pushed by the support arm against its bias to allow insertion of the support arm into the socket and to allow the respective formations to be brought into engagement to retain the support arm in the socket. When the support arm is not in the socket, the gate element (126) provides a substantially flush surface with the front surface of the housing.

42 Claims, 19 Drawing Sheets

(56) References Cited

U.S. PATENT DOCUMENTS

| | | | | |
|---|---|---|---|---|
| 3,697,034 | A * | 10/1972 | Shell | 248/243 |
| 4,223,862 | A * | 9/1980 | Doughty | 248/222.52 |
| 4,860,905 | A * | 8/1989 | Schott et al. | 211/59.1 |
| 5,110,079 | A * | 5/1992 | Evenson et al. | 248/222.13 |
| 5,145,135 | A | 9/1992 | Thompson | |
| 5,407,293 | A * | 4/1995 | Crainich | 403/322.1 |
| 5,961,082 | A | 10/1999 | Walter | |
| 6,199,706 | B1 * | 3/2001 | Shea | 211/87.01 |
| 6,371,313 | B1 | 4/2002 | Walter et al. | |
| 6,474,478 | B1 * | 11/2002 | Huehner et al. | 211/4 |
| 6,561,474 | B1 * | 5/2003 | Walter et al. | 248/220.22 |
| 6,574,924 | B2 * | 6/2003 | Maniezzo | 52/36.4 |
| 6,631,813 | B1 * | 10/2003 | Walter et al. | 211/94.01 |
| 6,644,483 | B1 * | 11/2003 | Lai | 211/87.01 |
| 6,769,656 | B1 * | 8/2004 | Botkin et al. | 248/220.31 |
| 7,866,492 | B2 * | 1/2011 | Walter | 211/103 |
| 8,128,043 | B2 * | 3/2012 | Walter | 248/224.7 |
| 2008/0217271 | A1 * | 9/2008 | Walter | 211/89.01 |
| 2009/0200441 | A1 * | 8/2009 | Kuhn et al. | 248/206.5 |
| 2009/0208281 | A1 * | 8/2009 | Noh | 403/349 |

FOREIGN PATENT DOCUMENTS

| | | |
|---|---|---|
| DE | 199 24 102 | 11/2000 |
| DE | 20 2004 004 783 | 6/2004 |
| EP | 0 716 825 | 6/1996 |
| EP | 0 834 274 | 4/1998 |
| GB | 2 378 214 | 2/2003 |

OTHER PUBLICATIONS

International Search Report dated Apr. 14, 2008 for Application No. PCT/AU2008/000408.

International Preliminary Report on Patentability and Written Opinion dated Sep. 29, 2009 for Application No. PCT/AU2008/000408.

* cited by examiner

SUPPORT ARM SYSTEM

This application is the U.S. National Phase of International Application No. PCT/AU2008/000408, filed Mar. 20, 2008, entitled "SUPPORT ARM SYSTEM", which claims the benefit of Australian Patent Application No. 2007901557, filed Mar. 23, 2007, and Australian Patent Application No. 2007901558, filed Mar. 23, 2007, which applications are hereby incorporated by reference in their entirety.

FIELD OF THE INVENTION

The present invention relates to a support arm system including a socket for inserting a support arm. Such support arm systems find particular, though not exclusive, application in hanging goods to be displayed or for supporting shelving assemblies.

BACKGROUND OF THE INVENTION

Support arm systems for hanging goods to be displayed or for supporting a shelving assembly are known. Support arm systems typically include a socket attached to a wall, column or other vertical surface, and a support arm that is removably inserted into the socket. The support arms are retained in the sockets using a number of different arrangements.

One arrangement is to provide a projection on the end of the support arm that extends from its upper surface. A corresponding undercut portion is provided inside the socket on the upper surface, such that the support arm is inserted into the socket at an upwardly tilted angle, so that the projection can be inserted in and up under the undercut portion. The support arm is then lowered. The projection is engaged in the undercut portion to prevent the support arm from any further downward movement. The disadvantage of this arrangement is that upward movement is still possible. Indeed, this is how the support arm is removed, by tilting the support arm upwardly to disengage the projection from the undercut. One of the problems with such an arrangement is that the support arm is relatively unstable, as it can be easily disengaged and can be moved up and down. This can present a problem when the arrangement is used as a support arm for garments, where hangers are suspended from the support arm. As customers look through the garments and remove the hangers from the support arm, the support arm is free to move up and down.

One attempt to overcome the problems associated with the above arrangement is to provide a rigid support arm that is permanently fixed to the vertical surface, by screws or the like. Whilst this arrangement overcomes the above mentioned problem, it reduces or removes the flexibility of the arrangement.

Another problem with some prior arrangements in some applications is that when the support arm is removed, the socket, including its insertion opening, is visible. This provides an aesthetically unpleasing appearance, particularly where a plurality of sockets on a single surface do not contain support arms. If the socket is not used for a long period of time, the insertion opening may accumulate dust and other particles. This may prevent subsequent use until the insertion opening is cleaned.

It is therefore an object of the present invention to provide an improved support arm system that at least in part alleviates one or more of the problems associated with known arrangements.

SUMMARY OF THE INVENTION

According to a first aspect, the present invention provides a support arm system, including:

a socket for attachment to a surface, and a support arm, for removable insertion in the socket, the support arm having at least one formation, the socket including:

a housing having an insertion opening leading to a passage for insertion of the support arm;

at least one formation in said passage complementary to said at least one formation on the support arm to engage the support arm when the support arm is in the socket; and a gate element in the passage biased to a position at or in front of said at least one formation in said passage;

wherein, to insert the support arm, the gate element must be pushed against its bias to expose the formation in the passage for engagement by the support arm to retain the support arm in the socket, the gate element providing a positive force between the support arm and socket while it is so retained.

In a second aspect, the invention provides a support arm system, including:

a socket for attachment to a surface and a support arm, for removable insertion in the socket, the support arm having at least one formation, the socket including:

a housing having a front surface and an insertion opening in the front surface for receiving the support arm;

at least one formation complementary to said at least one formation on the support arm and engageable therewith when the support arm is inserted into the socket for retaining the support arm in the socket; and a gate element moveable in said housing and having a periphery complementary to the insertion opening, said element being biased in a direction into said insertion opening from behind;

wherein, said gate element is pushed by the support arm against its bias to allow insertion of the support arm into the socket and to allow said respective formations to be brought into engagement to retain the support arm in the socket, and wherein, when the support arm is not in the socket, said gate element provides a substantially flush surface with the front surface of the housing.

The socket is preferably fixed to a vertical surface, at least when in use. Advantageously, the surface would include an aperture to allow the socket to sit within the surface. In one embodiment of the invention, a socket may be provided on both sides of a vertical panel.

Advantageously, the gate element is biased by a spring. The spring pushes against an internal rear surface of the socket housing. The insertion opening preferably leads to a passage in the housing along which the gate element travels and into which the support arm is inserted. Projections on the gate element may be complementary to channels in the passage walls, to assist in the alignment of the travel of the element.

According to one embodiment, the formation is a T-shaped protrusion projecting axially from an end of the support arm. The at least one formation on the socket includes shoulders behind which the protrusions are able to engage. Preferably, the support arm is axially inserted into the socket and rotated, e.g. approximately 90°, to engage the shoulders.

According to an alternative embodiment, the at least one formation on the support arm is an upwardly extending projection. The at least one formation on the socket, complementary to the formation on the support arm, is preferably an undercut portion behind the insertion opening. The support arm is preferably presented at an upward angle such that the support arm pushes the gate element away from the front surface as the support arm is inserted into the insertion opening. The upwardly extending projection engages in the undercut portion and the support arm is lowered into a near horizontal orientation. The gate element is prevented, by a shoulder, from being pushed past a point, such that the lower part of the support arm end face cannot move further, to create the cantilever lock for the support arm. Advantageously, the bias pushes the gate element against the back of the projection to create a positive engagement between the socket and the support arm.

A deformable lug may be provided on the lower side of the insertion opening. The element may have a corresponding recess to allow it to move over the lug. The support arm may include a second formation on its underside that the lug engages with to prevent additional upward movement.

In an embodiment, the aforementioned positive force is provided by the means biasing the gate element to said position at or in front of said at least arm formation, and is overcome by pushing the support arm further into said passage to push the gate element further back.

Preferably, when the support arm has been inserted into the socket and the formations engaged to retain the support arm therein, the support arm projects cantilever-fashion from the socket.

There may be means on the support arm to retain items on the support arm.

There may alternatively or additionally be a connection device on the support arm for connecting other components to the support arm.

BRIEF DESCRIPTION OF THE DRAWINGS

The invention will now be described, by way of example only, with reference to the accompanying drawings, in which.

DETAILED DESCRIPTION OF THE EMBODIMENTS

Figure 1:
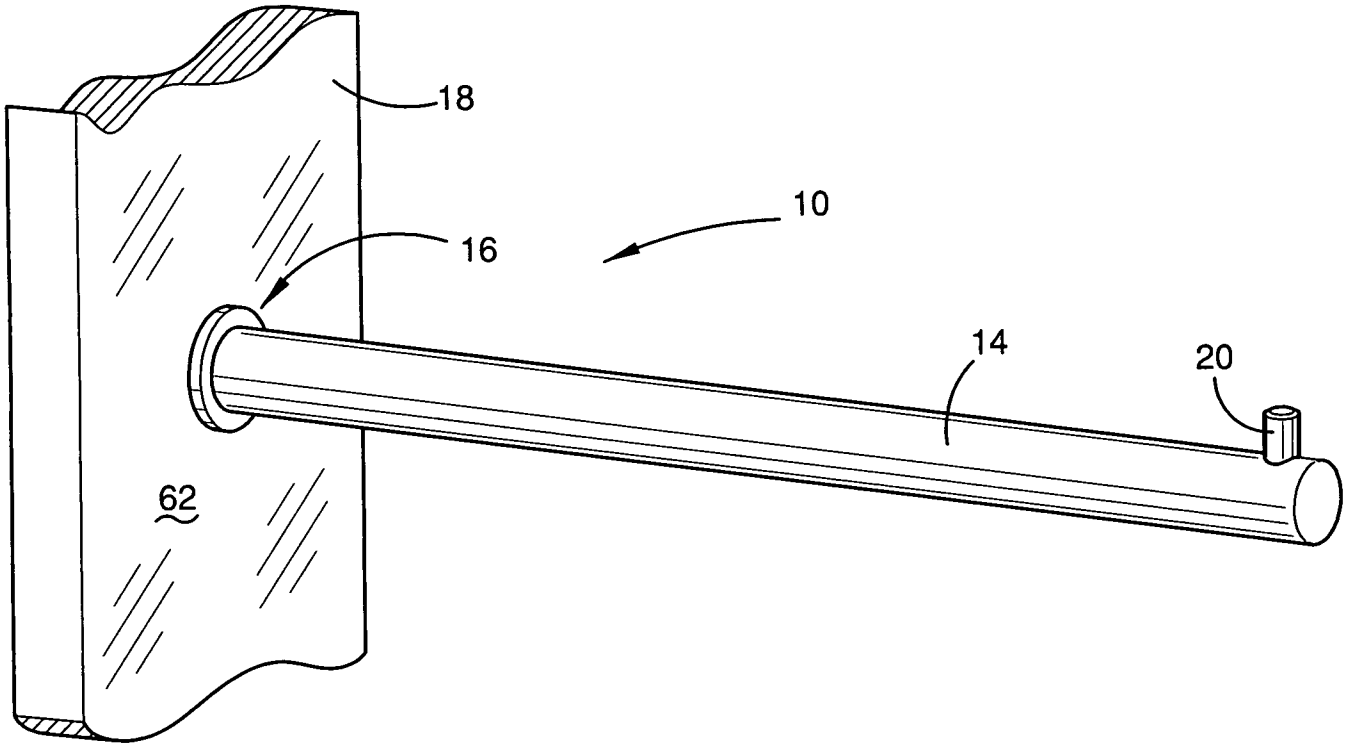
FIG. 1 is a front perspective view of a support arm system according to a first embodiment of the present invention.

FIG. 1 shows a support arm system 10 according to a first embodiment of the present invention, with a support arm 14 engaged in a socket 16. The socket 16 is fixed to a panel 18, which would typically be a vertical wall. The support arm 14 is of a generally elongate structure and is illustrated as being circular in cross-section. However, it will be appreciated that the present invention is not limited in this regard. The support arm 14 includes a lug 20 at its distal end, which prevents garment hangers and other suspended items from falling off the end of the support arm 14. It will be appreciated that other forms of the support arm are incorporated within the present invention. The support arm 14 may include a connection device, allowing other components to connect to the support arm.

Figure 2:
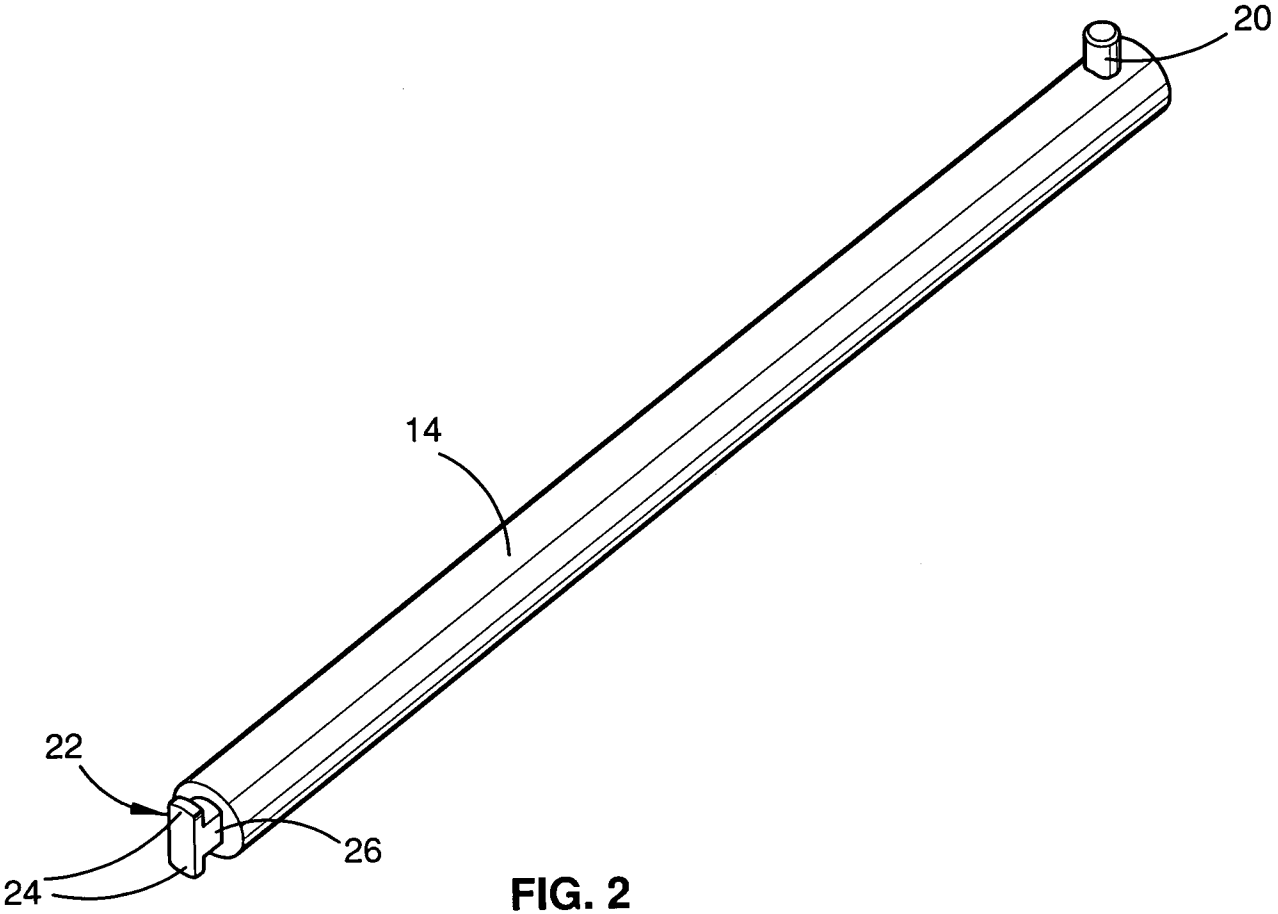
FIG. 2 is a rear perspective view of the support arm in the embodiment of FIG. 1.

As can be seen in FIG. 2, the support arm 14 includes a T-shaped protrusion 22, axially projecting from the end of the support arm that is inserted into the socket 16. The T-shaped protrusion 22 includes two lugs 24 that project laterally from an axial post 26.

Figure 3:
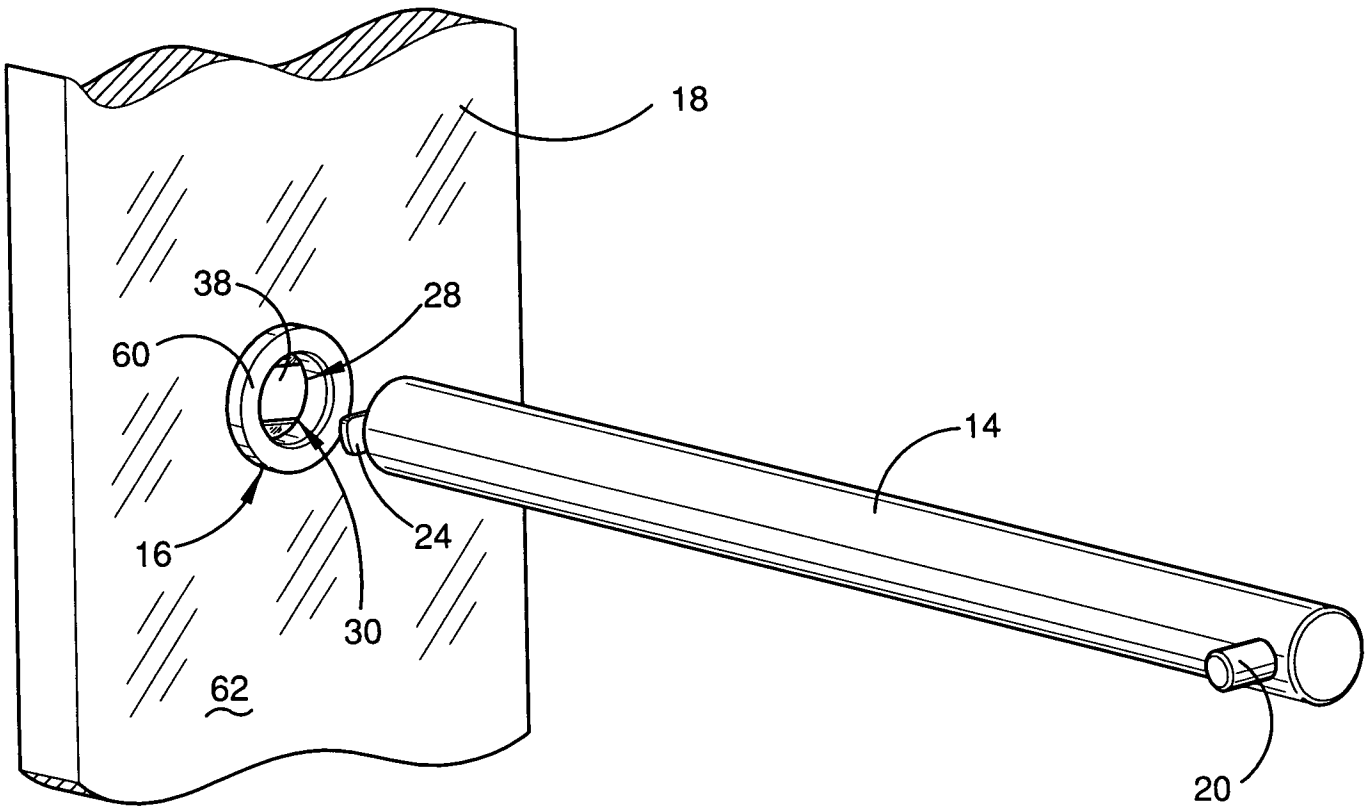
FIG. 3 is a front perspective view of the support arm system of FIG. 1, with the support arm disengaged.
Figure 4:
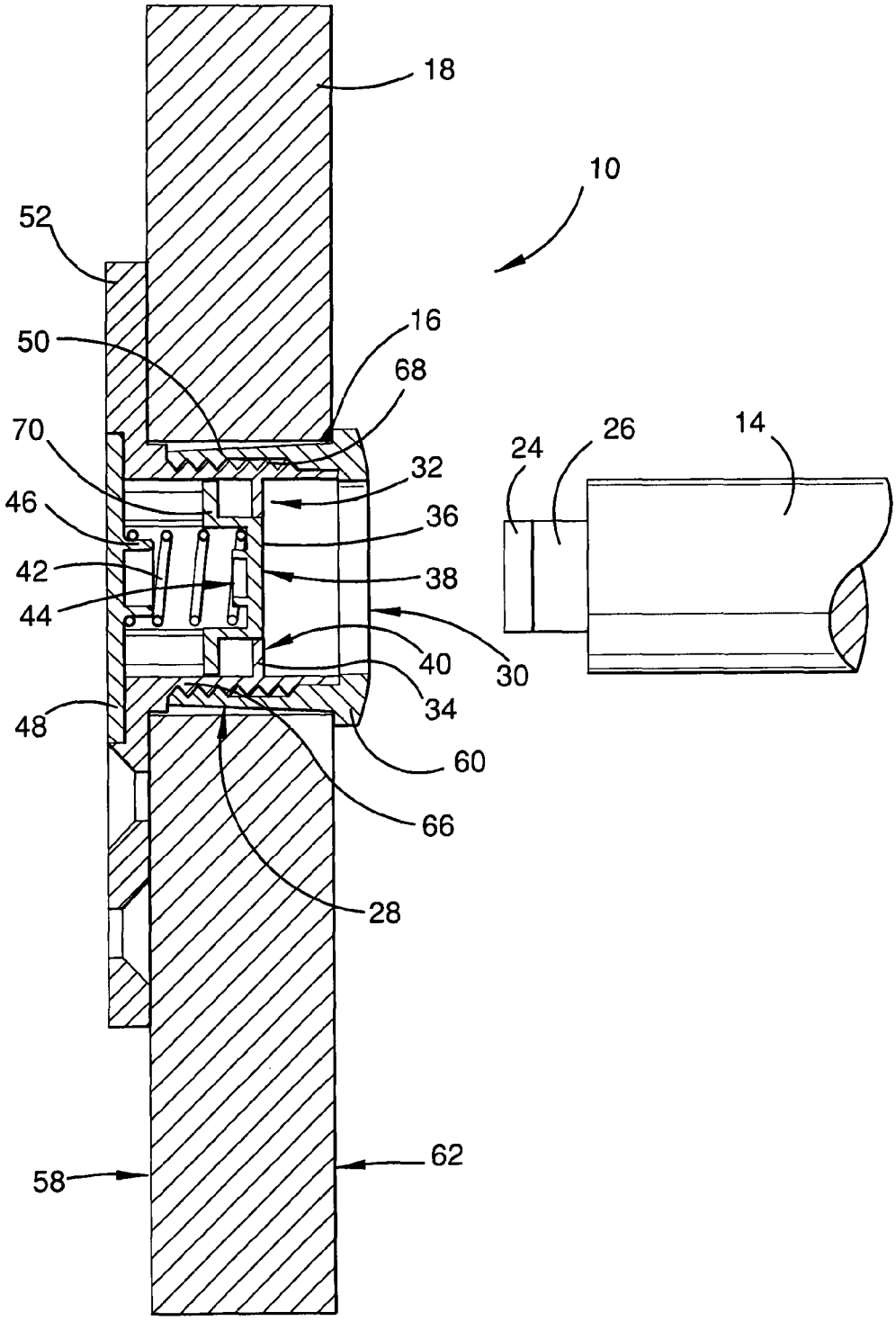
FIG. 4 is an axially-sectioned side view of the support arm system as shown in FIG. 3.
Figure 5:
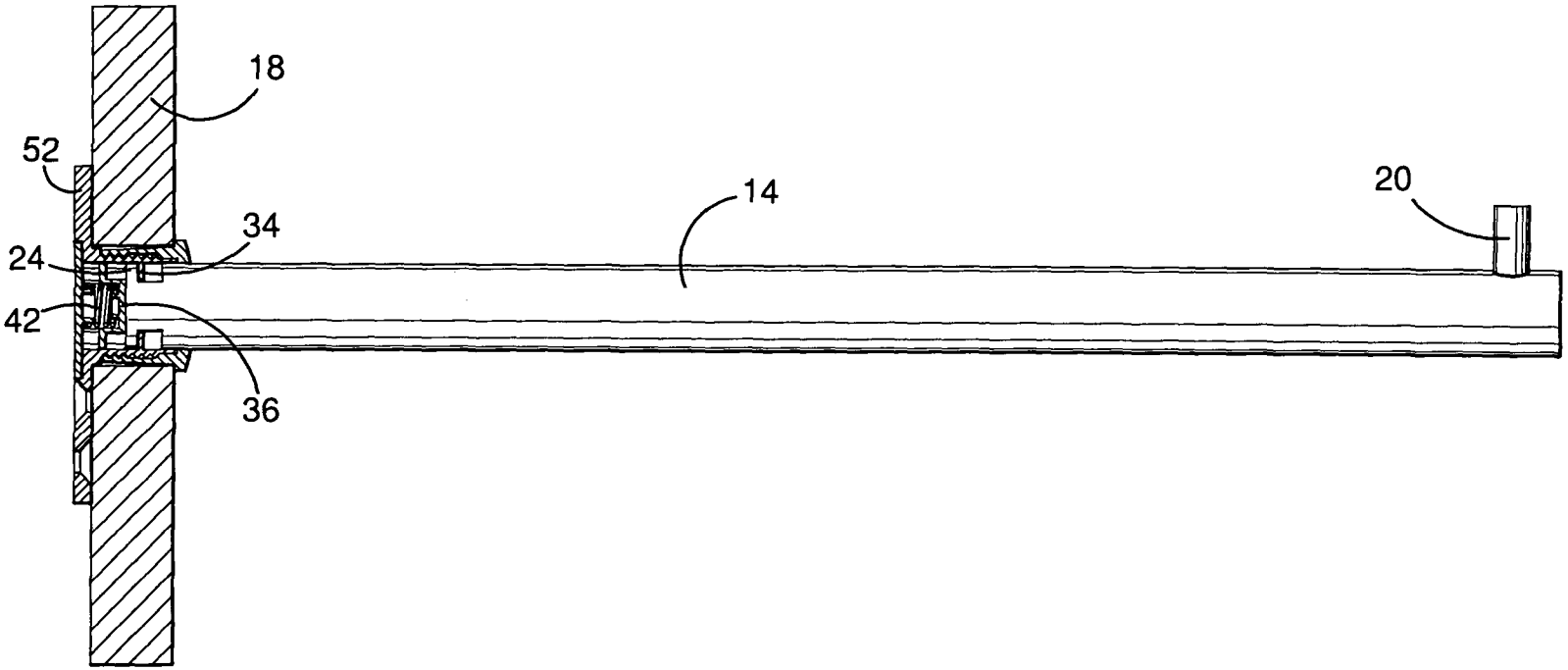
FIG. 5 is a view similar to FIG. 4 of the support arm system, with the support arm engaged.
Figure 6:
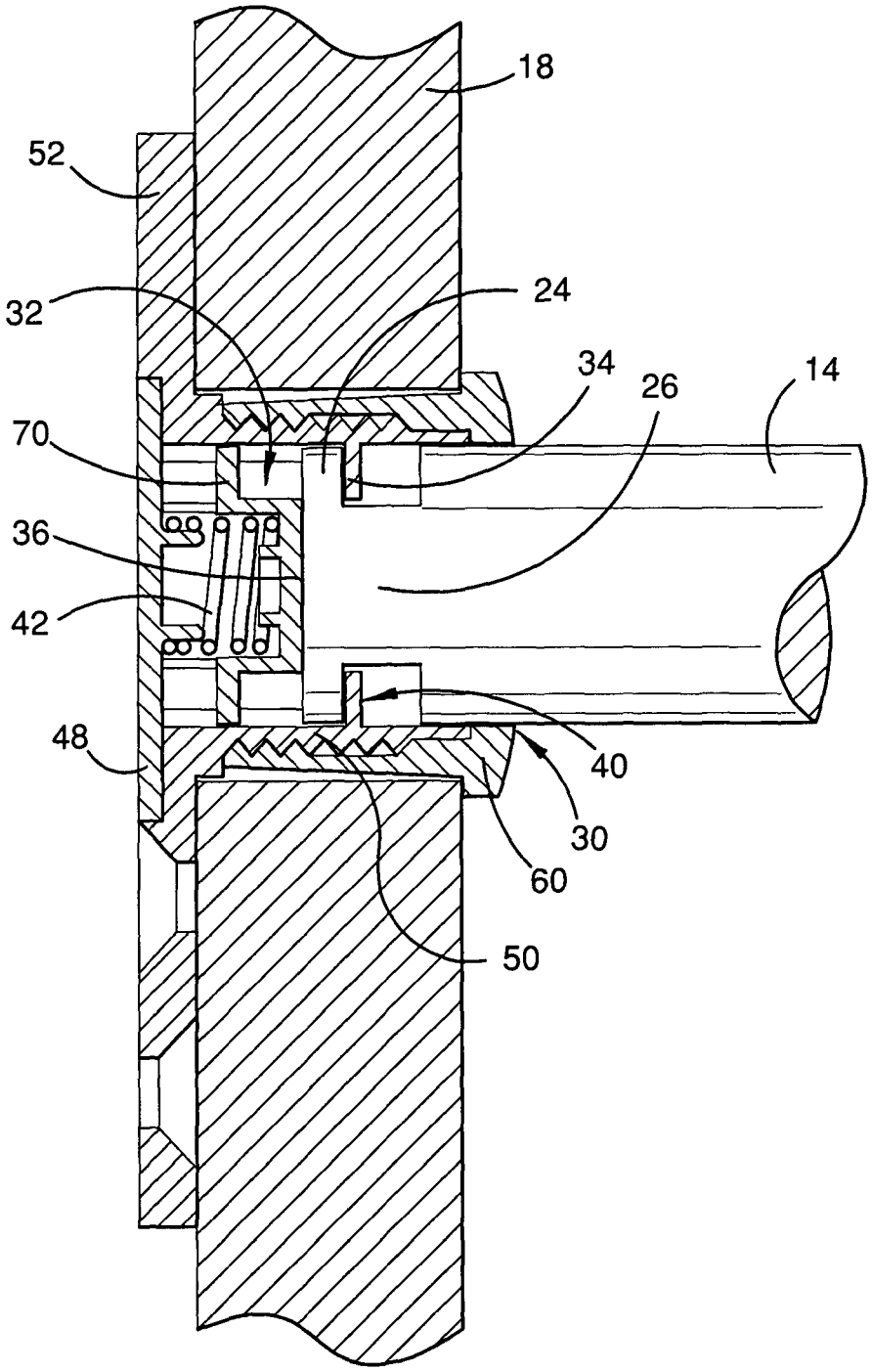
FIG. 6 is an enlargement of part of FIG. 5.

Referring to FIG. 3, socket 16 includes a housing 28 that has an insertion opening 30 which leads to a passage 32 for insertion of the support arm 14. Formations in the passage 32 complementary to the lugs 24 on the support arm 14 and engage the support arm 14 in the socket 16. These are illustrated in FIGS. 4, 5 and 6. The passage formations are formed by shoulders 34, which the lugs 24 engage behind to hold the support arm 14 in the socket 16. The shoulders 34 are half moon shaped walls extending across the width of the passage 32.

As shown in FIG. 4, a gate element 36 in the passage 32, hereinafter referred to as a gate, is biased to a position at or in front of the shoulders 34. In the illustrated embodiment, the gate 36 is shown as being behind the insertion opening 30 and the front surface 38 of the gate 36 is aligned with the front surfaces 40 of the shoulders 34. The gate 36 is biased to this position by spring 42, which engages in the recess 44 in the rear of the gate 36 and about a post 46 on the rear closure 48 of the housing 28.

Figure 9:
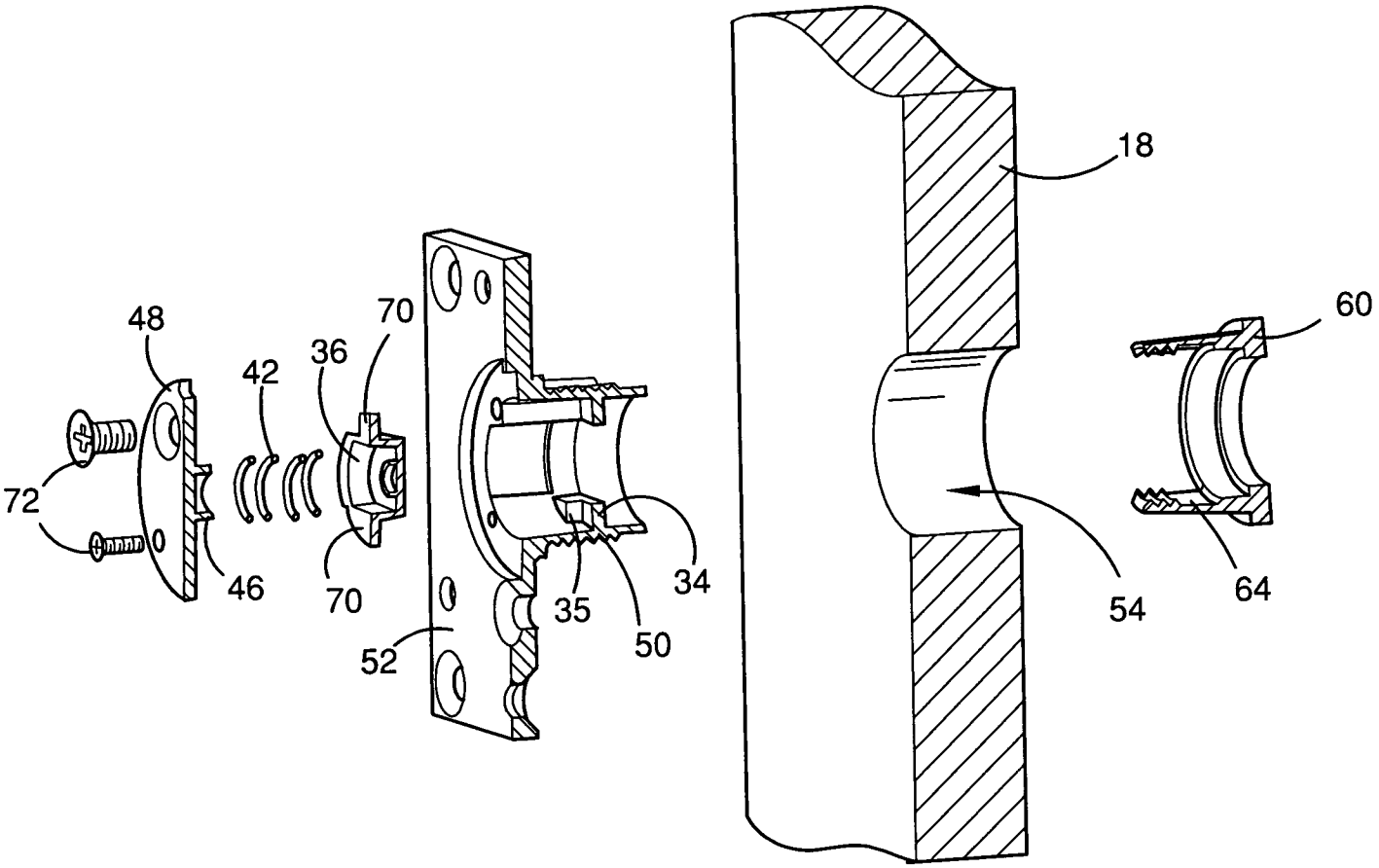
FIG. 9 is an exploded rear perspective axially-sectioned view of the support arm system of FIG. 1.

As can be seen from FIG. 4, the support arm 14 is presented to the socket insertion opening 30 with the lugs 24 extending sideways, such that the support arm 14 is inserted into the passage 32 past the shoulders 34. The support arm 14 must push the gate 36 against its spring bias to expose the shoulders 34 for engagement by the lugs 24. Once the lugs 24 have been pushed past the shoulders 34, the support arm 14 is rotated 90° and is prevented from further rotation by stops 35, which can be seen in FIG. 9. The lugs 24 are then engaged with the rear surface of the shoulders 34 to prevent axial withdrawal. As the gate 36 is biased towards the insertion opening 30, the gate 36 pushes the T-shaped protrusion 22 against the shoulders 34, providing a positive force between the support arm 14 and the socket 16.

To remove the support arm 14 from the socket 16, the spring bias must be overcome before the support arm 14 can be disengaged. The support arm 14 must be pushed against the gate 36 to allow the lugs 24 to disengage from the shoulders 34, allowing the support arm 14 to be rotated and axially removed. The support arm 14 can only be rotated in one direction, away from the stops 35.

Figure 7:
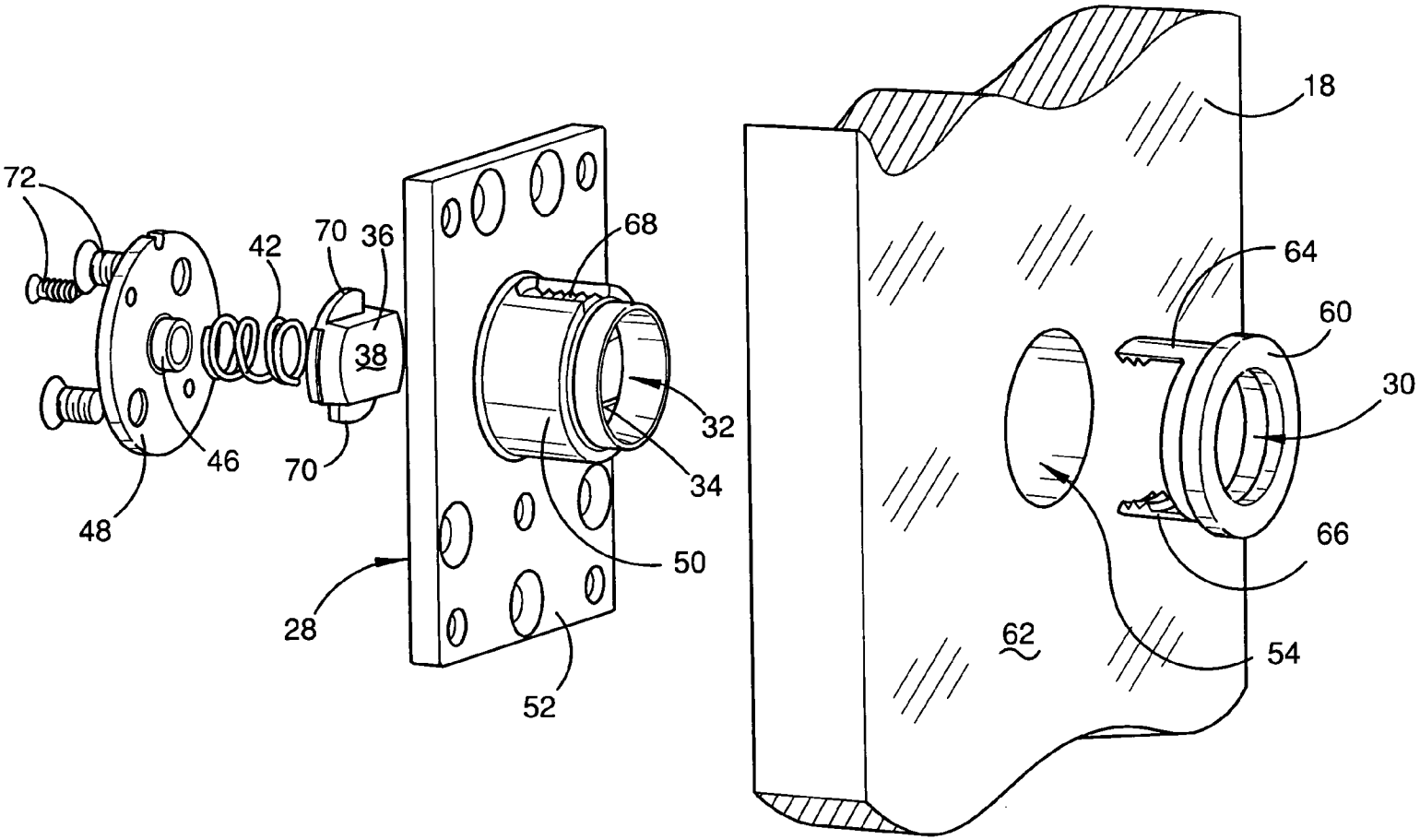
FIG. 7 is an exploded front perspective view of the support arm system of FIG. 1.
Figure 8:
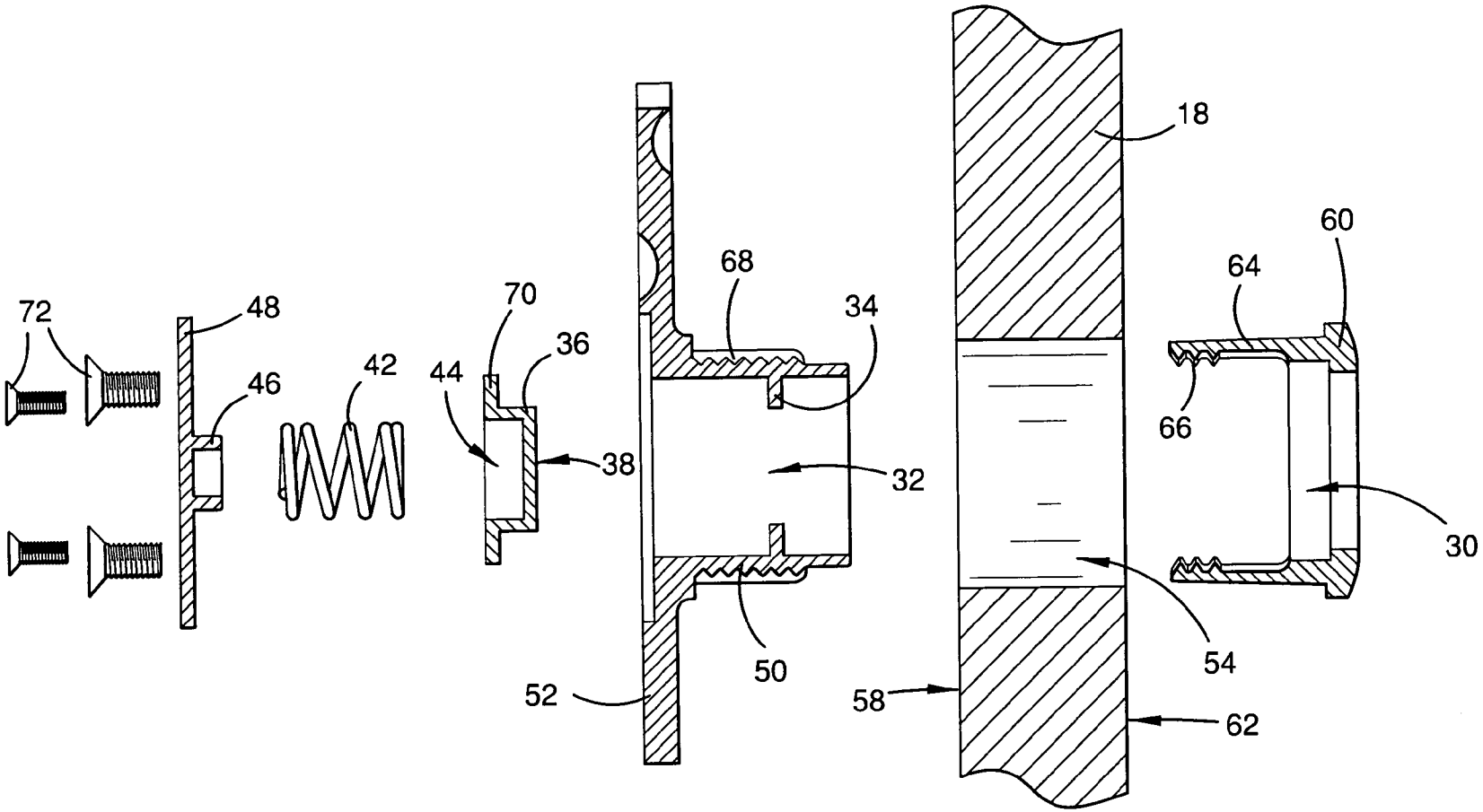
FIG. 8 is an exploded, partially sectioned, side view of the support arm system of FIG. 1.

As can be seen in FIGS. 7 and 8, the socket housing 28 includes a tubular portion 50 extending from a rear plate 52 that defines the passage 32. The tubular portion 50 is inserted through an aperture 54 from the rear 58 of a panel 18. The rear plate 52 is then fixed to the panel 18 with screws. A front cap 60 is inserted from the front 62 of the panel 18 and locks onto the tubular portion 50 by arms 64 that have teeth 66 that engage with corresponding teeth 68 on the outside of the tubular portion 50. The outside diameter of the front cap 60 is greater than the diameter of aperture 54, so that the front cap 60 sits in front of the panel 18. It will be appreciated that in other forms of the invention, the front cap can be inserted from the rear of the panel 18.

The gate 36 is inserted from the rear 58 of the panel 18. As can be seen best in FIG. 7, the gate 36 includes two flanges 70. When the gate 36 is biased towards the insertion opening 30, the flanges 70 prevent it from being pushed past the shoulders 34. The spring 42 and rear closure 48 are then fixed in place by screws 72.

One advantage of the arrangement illustrated in FIGS. 1 to 9 is that when the support arm 14 is inserted in the socket 16, it is positively engaged, which minimises any movement of the support arm 14 with respect to the socket 16. The positive engagement of the gate 36 prevents rotational movement and disengagement of the support arm 14 from the socket 16 without overcoming the bias of the gate 36. This provides a stable and effective support arm system.

Figure 10:
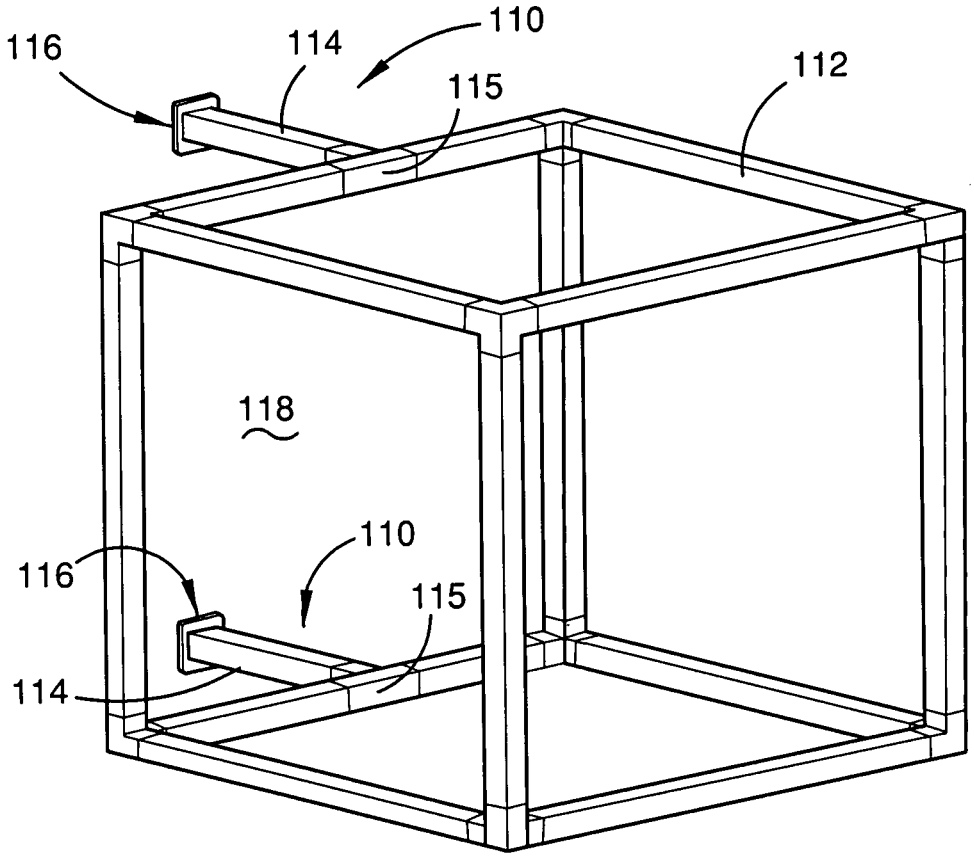
FIG. 10 is a perspective view of two support arm systems according to a second embodiment of the present invention supporting a frame structure.
Figure 11:
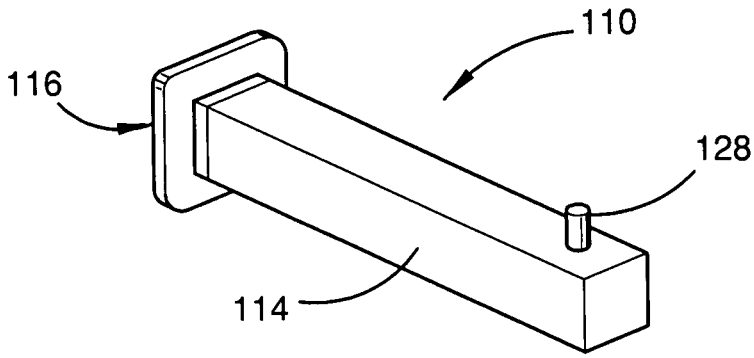
FIG. 11 is a perspective view of the support arm system of FIG. 10 with a support arm according to a modification of the second embodiment of the present invention.

It will be appreciated that this invention may be used with socket and support arms that engage using an arrangement different from that described above, and is not limited to axial insertion and rotation of the support arm in the socket. Alternative embodiments of the invention are illustrated in FIGS. 10 to 26 in which the support arm, opening and gate are of rectangular profile, and in which the support arm includes a projection extending upwardly from the upper surface at the insertion end. FIGS. 10 and 11 show a support arm system 110 according to the second embodiment in use. In FIG. 10, two systems 110 are supporting a frame structure 112. In FIG. 11, a system 110 is being used as a display rack.

Figure 15:
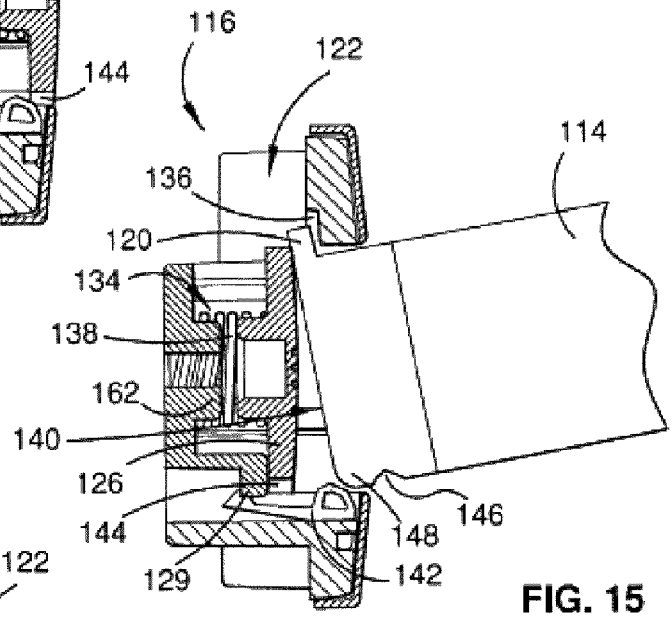
FIG. 15 is a sectional view, similar to FIG. 14, of the support arm system of the second embodiment with a support arm being inserted into the socket.
Figure 16:
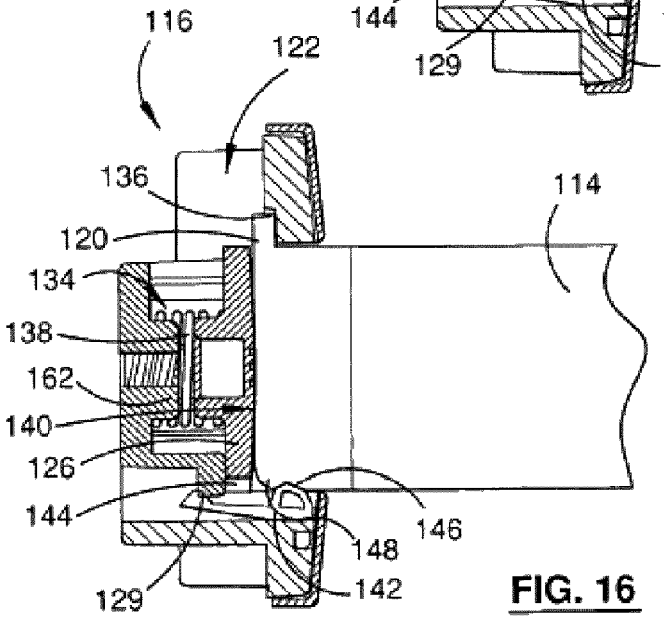
FIG. 16 is a sectional view, similar to FIG. 14, of the support arm system of the second embodiment with a support arm inserted into the socket.

The support arm system 110 according to the second embodiment of the present invention includes a support arm 114 and a socket 116. The socket 116 is fixed to a vertical wall surface 118. The support arm 114 is of a generally elongate structure and is illustrated as having a square cross-section. However, it will be appreciated that the present invention is not limited in this regard. The support arm 114 includes a formation in the form of a projection 120, which is best shown in FIGS. 15 and 16. The projection 120 is a strip that extends across the width of the support arm 114 and extends upwardly from the top surface at the insertion end of the support arm 114. At the opposite end of the support arm 114 there may be provided some form of engagement means. As shown in FIG. 11, this could include a lug 128, which prevents garment hangers and other suspended items from falling off the end of the support arm 114. Alternatively, as shown in FIG. 10, the support arm 114 may include a connection device 115, allowing other components to connect to the support arm 114, such as the frame structure 112.

The drawings illustrate two alternative configurations of the socket of the second embodiment. The first configuration, depicted in FIG. 14, includes a housing 122 having a front surface 124 and a gate element 126 that provides a flush surface with the front surface 124. The configuration shown in FIG. 12 similarly shows a socket 216 including a housing 222 having a front surface 224 and a gate element 226 that provides a flush surface with the front surface 224. Like elements of the two configurations are indicated by like 2-digit numerals respectively preceded by a "1" or a "2".

Figure 14:
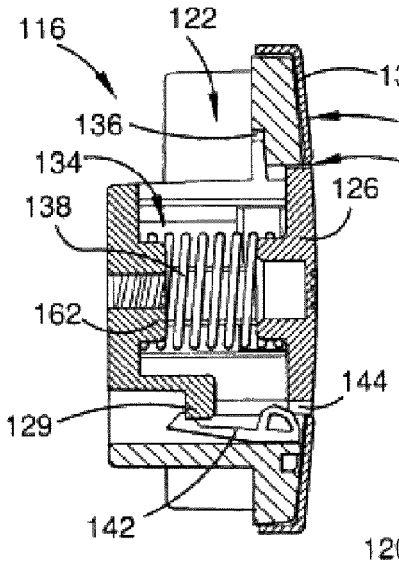
FIG. 14 is a vertical axial sectional view of the socket of FIG. 12.

As shown in FIG. 14, the housing 122 includes a front cap 130 that provides the front surface 124. The front cap 130 includes an insertion opening 132 in the front surface 124 that leads to a passage 134 for receiving the support arm 114. A formation complementary to the projection 120 on the support arm 114 is provided in the housing 122. As can be seen in FIGS. 14, 15 and 16, an undercut portion 136 is provided behind the insertion opening 132 and behind the front cap 130. The undercut portion 136 extends across the full width of the insertion opening 132. This allows the support arm 114 to engage in the socket 116.

The gate element 126 is complementary to the insertion opening 132, having a perimeter that matches the insertion opening 132. The gate element 126 is biased by a spring 138 in a direction into the insertion opening 132 from behind, as shown in FIG. 14. To insert the support arm 114, as shown in FIG. 15, the support arm 114 is presented at an upwardly inclined angle and pushes back the gate element 126. The projection 120 engages in the undercut portion 136 and the support arm 114 is lowered into a generally horizontal orientation, as shown in FIG. 16. The gate element 126 is spring biased to push against the rear surface 140 of the support arm 114. This provides a positive engagement, as it pushes the projection 120 against the undercut portion 136.

The gate element 126 is prevented, by a shoulder 129, from being pushed past it, such that the lower part of the support arm rear surface 140 cannot move further. This means that the support arm 114 cannot be inserted any further into the passage 134. The cantilever effect of the support arm 114 is locked against the shoulder 129, as it prevents downward movement of the support arm 114.

To increase the positive engagement of the support arm 114 in the socket 116, a deformable lug 142 is provided on the lower side of the insertion opening 132. The gate element 126 includes a recess 144 that allows it to move over the lug 142 without getting caught. On the underside of the support arm 114 there is provided a second formation in the form of a channel 146 across its width. As the support arm 114 is tilted from the angled position shown in FIG. 15 to the horizontal position shown in FIG. 16, the ridge 148 pushes over the lug 142, deforming it downwardly, until it snaps into the channel 146 on the underside of the support arm 114. This prevents the support arm 114 from easily being disengaged by tilting the support arm 114 upwardly.

To remove the support arm 114, it is tilted upwardly, which pushes against the gate element 126. The top half of the gate element 126 tilts backwards to allow the channel 146 to disengage from the deformable lug 142 and the projection 120 to slide out from under the shoulder 136.

Figure 12:
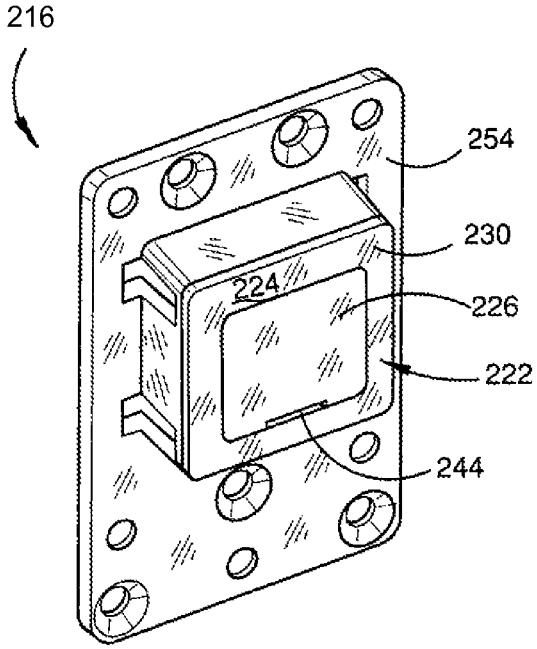
FIG. 12 is a front perspective view of a socket of the support arm system of FIG. 10.
Figure 13:
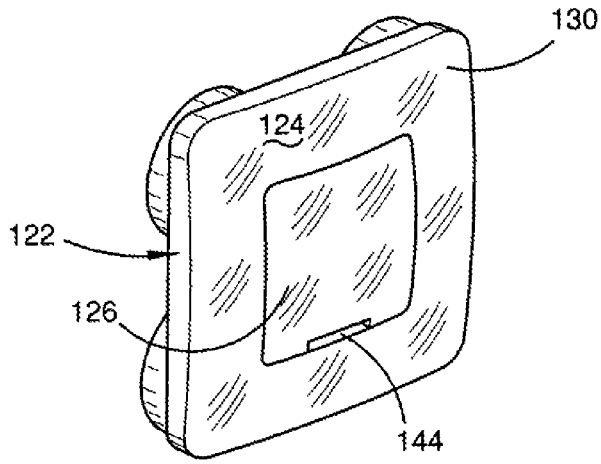
FIG. 13 is a front perspective view of a socket of the support arm system of FIG. 11.
Figure 17:
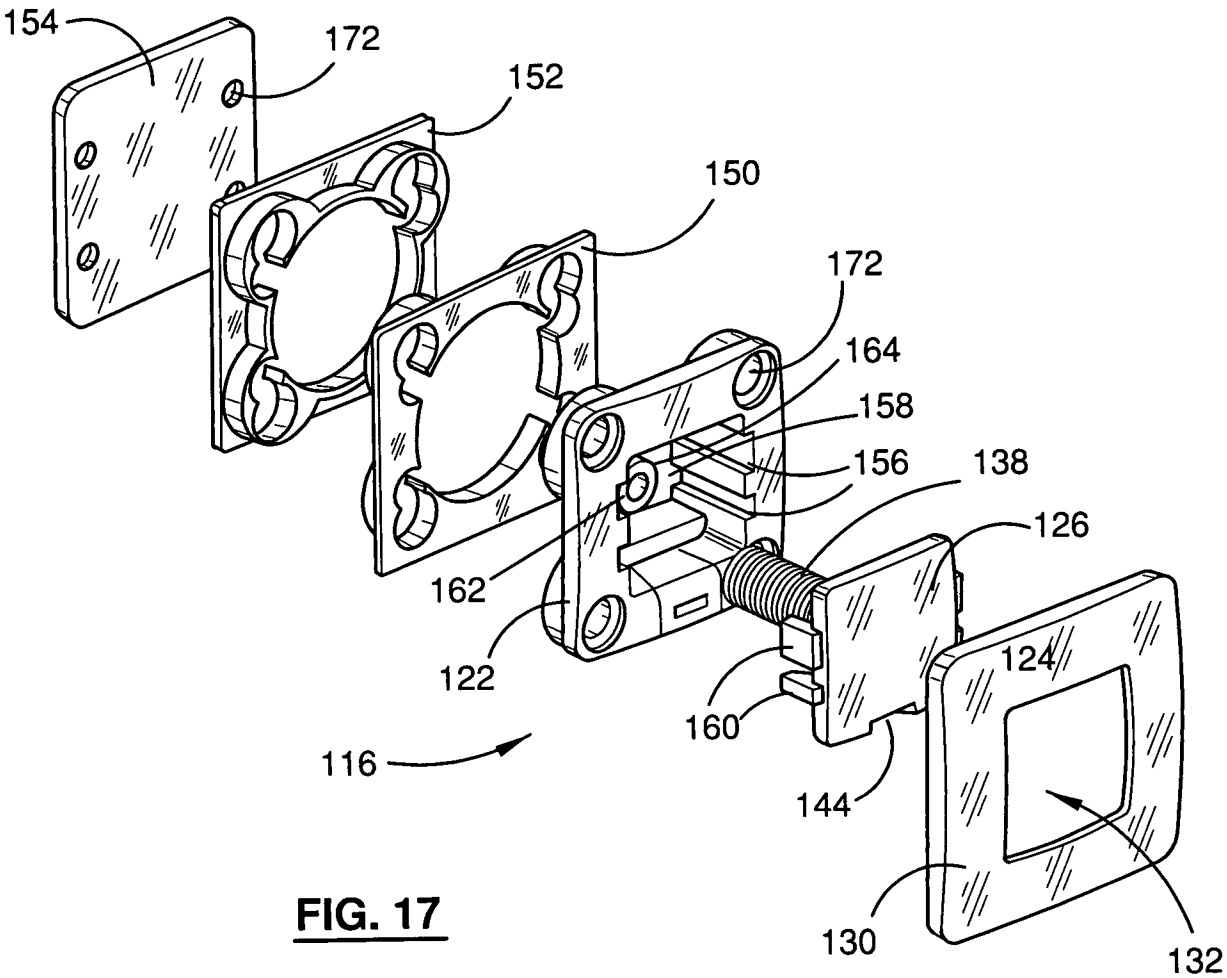
FIG. 17 is an exploded front perspective view of the socket of FIGS. 12 and 14 to 16.

The construction of the first configuration of the socket 116 is shown in FIG. 17. The housing 122 includes brackets 150, 152 and rear plate 154 that are used to fix the socket 116 to a panel, to be explained below. The housing 122 includes the front cap 130 having the insertion opening 132. The housing also includes the passage 134 into which the gate element 126 travels. The passage 134 has ridges 156 on the passage walls 158. Lateral tabs 160 on the side edges of the gate element 126 slidingly engage the ridges 156 and allow the gate element 126 to travel in alignment along the passage 134. The spring 138 is connected to the rear surface of the gate element 126 about a post and also about a post 162 on the rear surface 164 of the passage 134. When a support arm 114 is not in engagement with the socket 116, the spring 138 biases the gate element 126 into the insertion opening 130, providing a flush surface with the front surface 124, as shown in FIG. 12.

Figure 18:
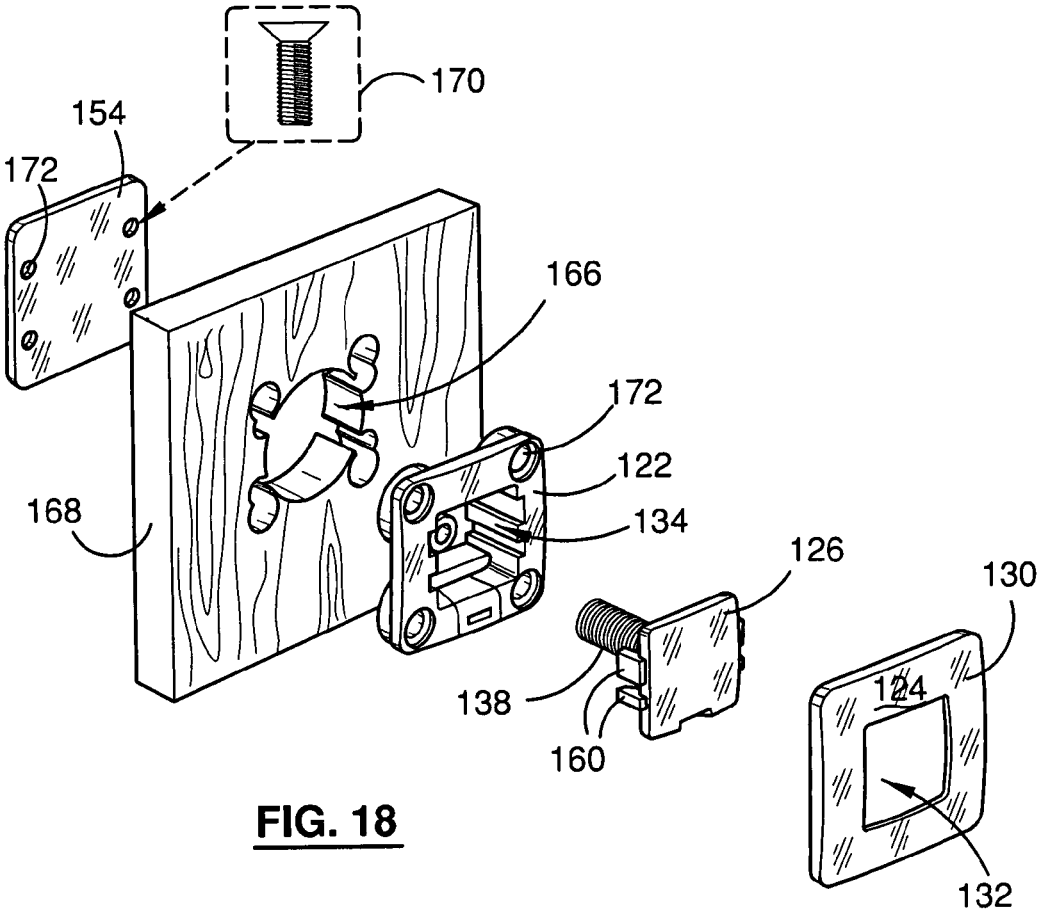
FIG. 18 is an exploded front perspective view of the support arm system of the second embodiment being installed in a wood panel.
Figure 19:
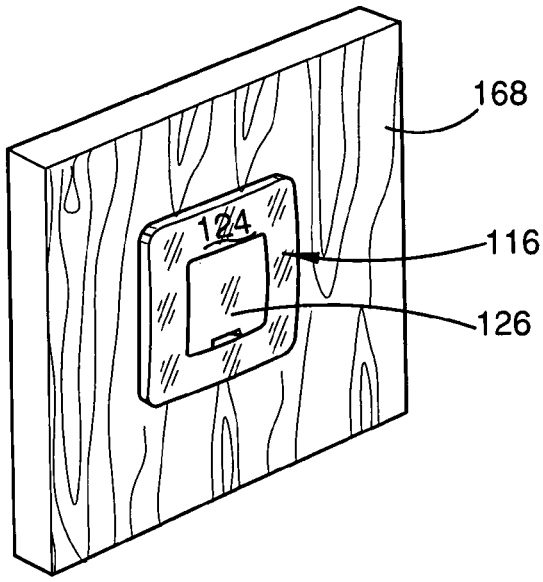
FIG. 19 is a front perspective view of the support arm system of the second embodiment installed in the wood panel of FIG. 18.

As can be seen in FIG. 18, an aperture 166 is cut into the wood panel 168. The housing 122 is inserted into the aperture and the rear plate 154 is fixed to the housing on the other side of the wood panel 168 with screws 170 through holes 172. The gate element 126 is inserted into the passage 134 and the front cap 130 is fitted on the front. The front cap 130 may be fitted onto the housing by tolerance fit or another form of fixing may be used, such as adhesive. As shown in FIG. 19, when a support arm 114 is not engaged in the socket 116, a flush surface is presented. This is aesthetically pleasing, which is particularly important in a retail environment. As the passage 134 is not exposed, dust and particles will not build up, which over time could prevent the insertion of a support arm 114.

Figure 20:
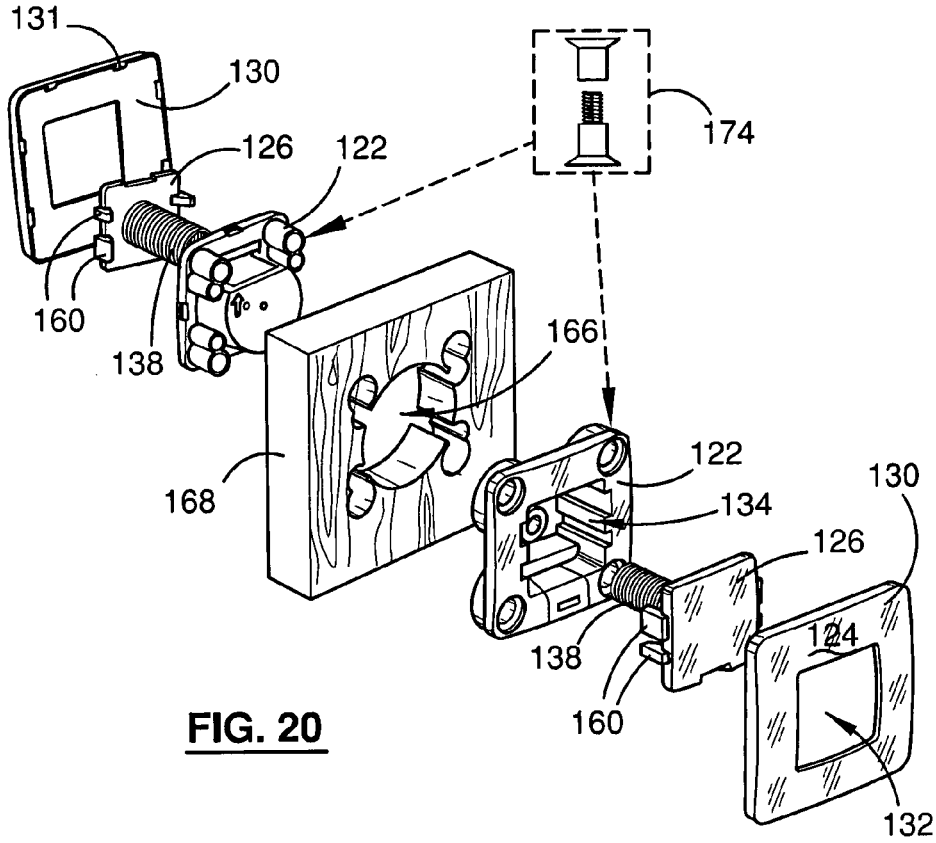
FIG. 20 is an exploded front perspective view of a support arm system according to a third embodiment being installed in a double-sided manner in a wood panel.
Figure 21:
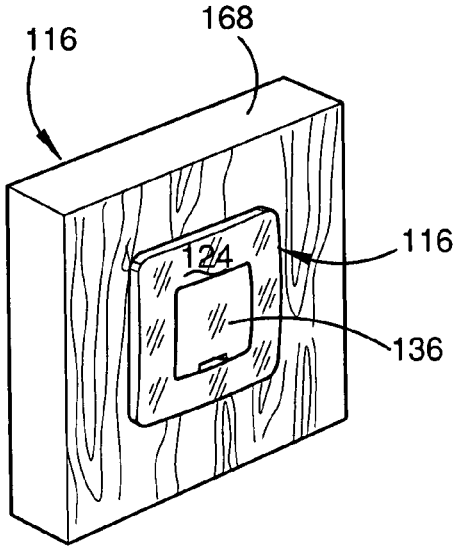
FIG. 21 is a front perspective view of the support arm system of the third embodiment installed in the wood panel of FIG. 20.
Figure 22:
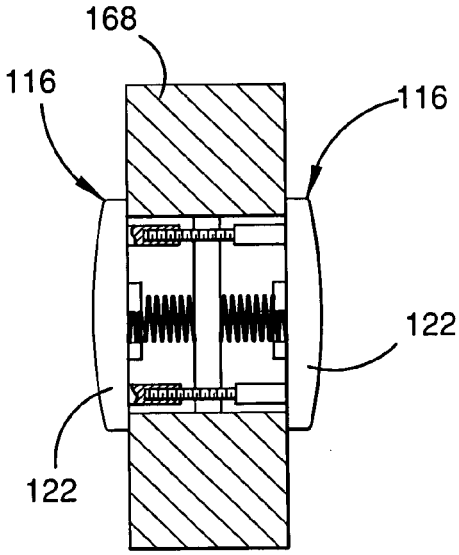
FIG. 22 is sectional side view of the support arm system of the third embodiment installed in the wood panel of FIG. 20.

As shown in FIGS. 20, 21 and 22, a socket 116 according to a third embodiment can be used to create a double-sided display. An aperture 166 is cut into the wood panel 168, similar to that shown in FIG. 18. The thickness of the wood panel 168 is approximately double, thus allowing two housings 122 to be inserted into opposite sides. Double ended screws 174 are used to fix the two housings 122 together, omitting the need for a rear plate 154. Assembly of the gate element 126 and front cap 130 is the same as described above. FIG. 20 shows that one way of fixing the front cap 130 to the housing 122 is by snap lock tabs 131. As shown in FIG. 22, a double-sided display provides sockets 116 on both sides of the panel 168 and allows a support arm 114 to extend from both sides.

Figures 23, 24:
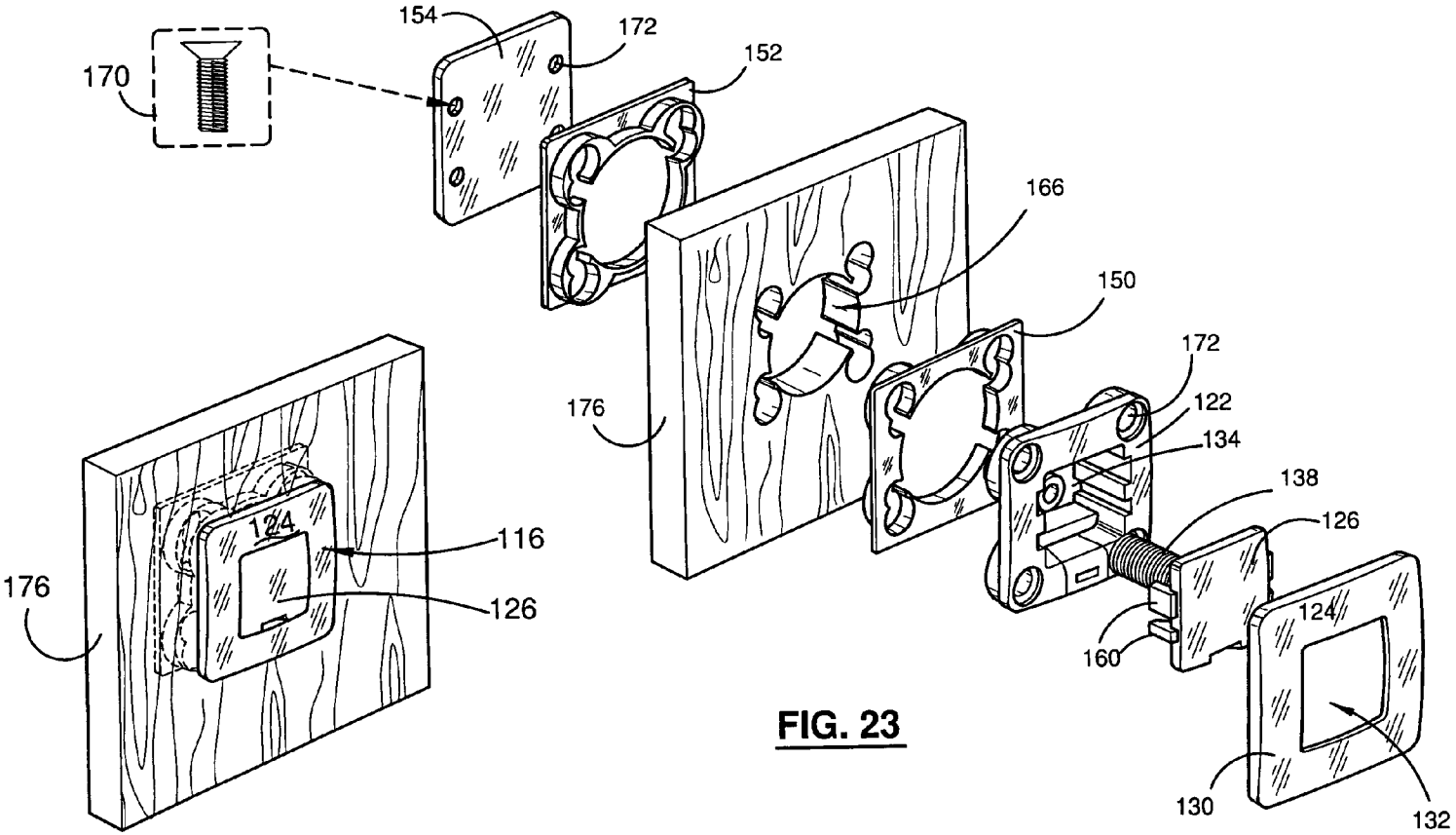
FIG. 23 is an exploded perspective view of the support arm system of the second embodiment being installed in a glass panel.
FIG. 24 is a front perspective view of the support arm system of the second embodiment installed in the glass panel of FIG. 23.

The use of the brackets 150, 152 shown in FIG. 17 allows a socket 116 according to the second embodiment to be fixed to a glass panel 176 (FIGS. 23 and 24). The brackets 150, 152 are made from a plastic, preferably rubberised, material to absorb vibrations, protecting the glass panel 176 from fracture. Again, as shown in FIG. 24, when the support arm 114 is not engaged in the socket 116, a flush surface provides an aesthetically pleasing appearance and prevents the collection of dust.

Figure 25:
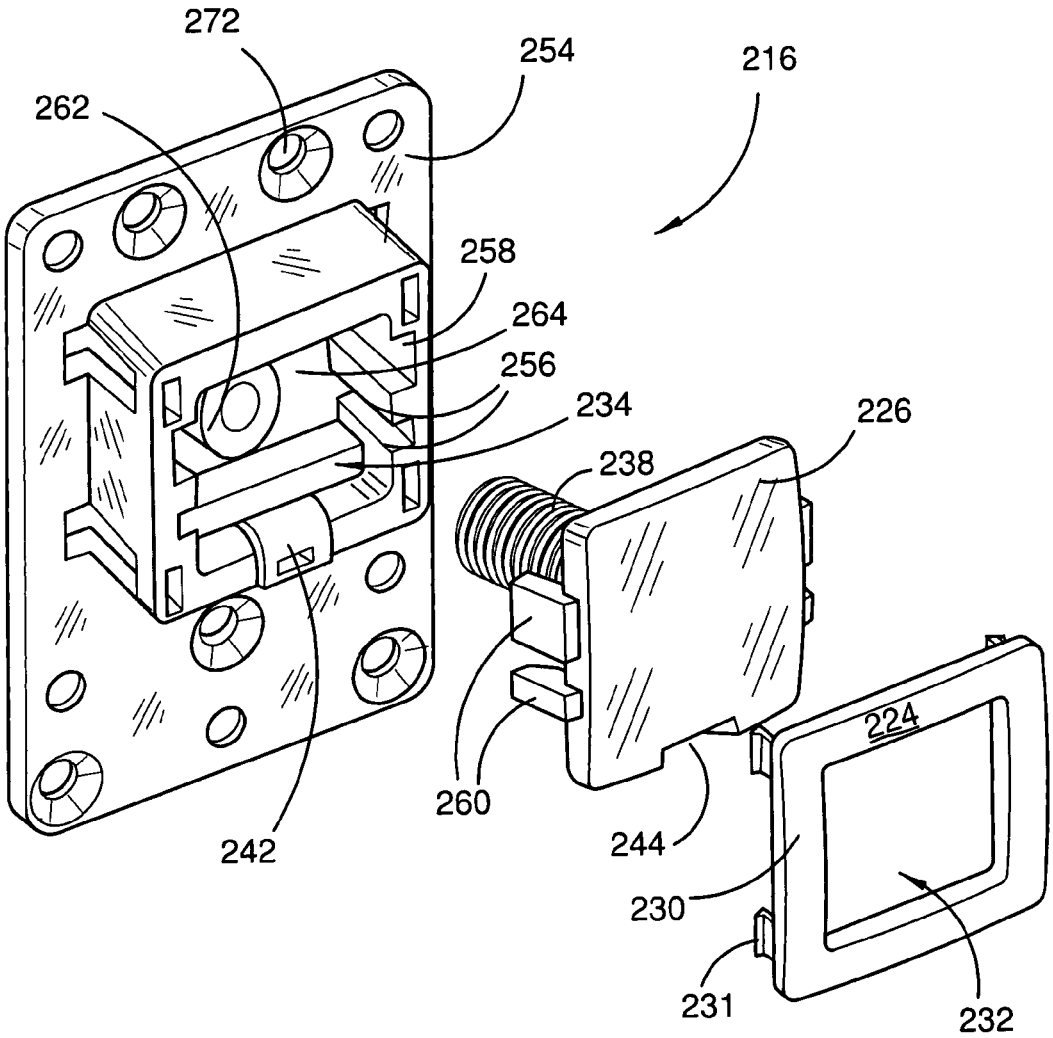
FIG. 25 is an exploded front perspective view of the socket of the embodiment of FIG. 13.
Figure 26:
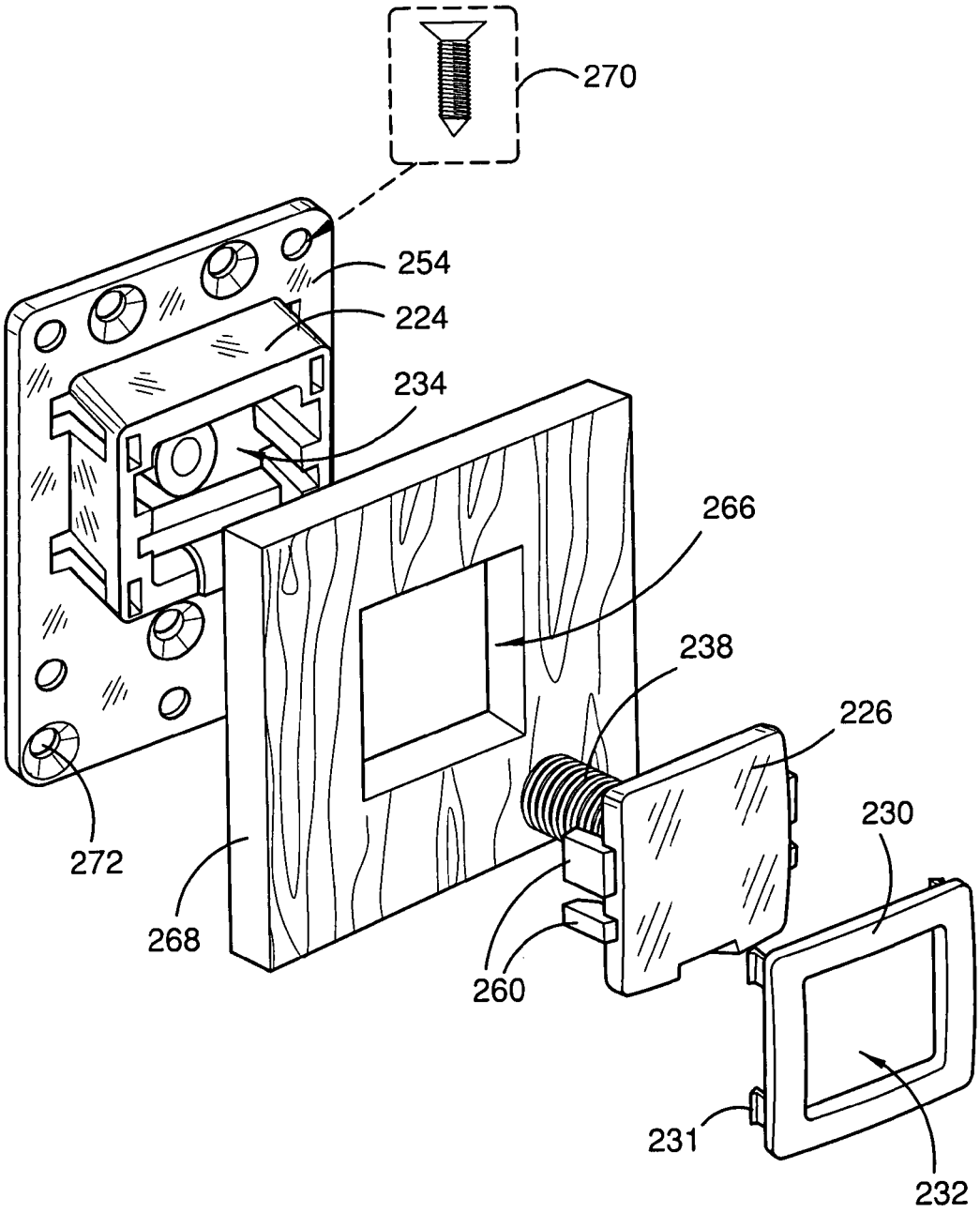
FIG. 26 is an exploded front perspective view of the support arm system of the embodiment of FIG. 25 being installed in a wood panel.

An alternative embodiment of the socket 216 is illustrated in FIGS. 25 and 26. The socket includes a housing 222, which includes all of the features present in the earlier described construction, and like reference numerals are used with the prefix 2 instead of 1. The main difference between the embodiments is that the housing 222 and the rear plate 254 are an integral piece. As shown in FIG. 26, an aperture 266 is provided in the wood panel 268 and the housing 222 is inserted from the rear side into the aperture 266. The rear plate 254 is fixed to the rear side of the element with screws 270. The gate element 226 is then inserted into the passage 234 and the front cap 230 is snap locked onto the inside of the housing 222 by tabs 231.

The second and third embodiments of the invention includes the feature of a biased gate element, such that when a support arm is not inserted into the socket, a flush surface is presented. It will be appreciated that this invention may be used with socket and support arms that engage using a different arrangement to that described above. The socket insertion opening, gate element and support arm may all be circular, as in the first embodiment of the invention. The engagement may include axial insertion and rotation to engage respective formations on the support arm and socket. Other engagement arrangements are also covered by the present invention.

Figure 27:
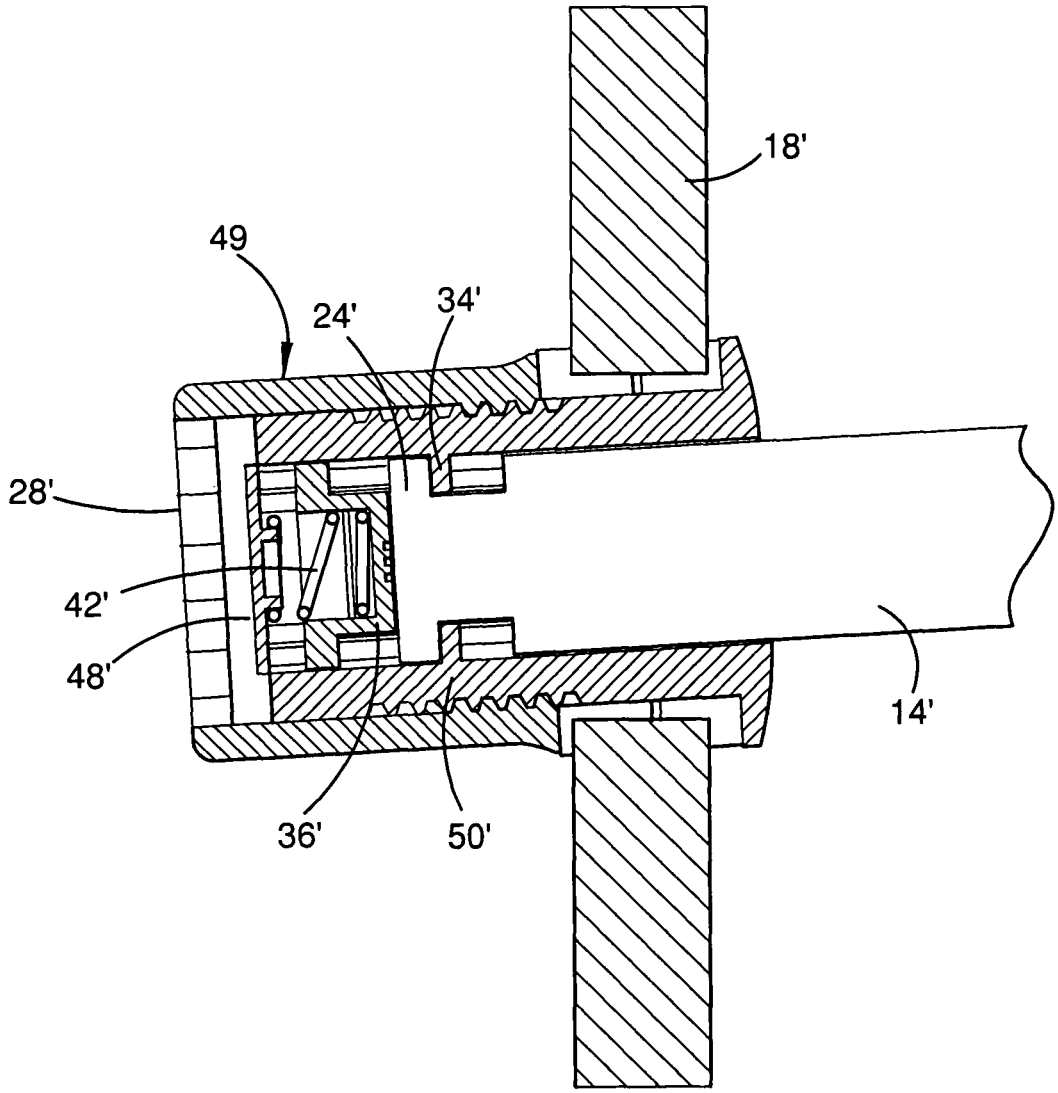
FIG. 27 is an axial cross-sectional view of a modification of the first embodiment of the invention.

FIG. 27 is an axial cross-sectional view of a modification of the first embodiment of the invention. The principal change is that the tubular portion 50' of the socket housing is significantly lengthened rearwardly to increase the length of the support arm 14 that is within the housing. This can be useful for enhancing the stability of the cantilvered arm, especially where it is to be rated for higher loads. It will also be noted that the rear of the housing 28', which, because of the extension of tubular portion 50', protrudes significantly behind panel 18', is completed by a cylindrical cap 49 which extends about tubular portion 50' and rear closure 48'. The configuration of FIG. 27 also illustrates an arrangement in which housing 28' is configured to seat in the panel aperture so that support arm 14' projects at a slight upward angle.

The invention claimed is:

1. A support arm system, including:

a socket for attachment to a surface and a support arm, for removable insertion in the socket, the support arm having at least one formation, the socket including:

a housing having an insertion opening leading to a passage for insertion of the support arm;

at least one formation two shoulder formations projecting into said passage, each extending from one side of the passage to the other, complementary to said at least one formation on the support arm to engage the support arm when the support arm is in the socket; and a gate element in the passage biased to a position at or in front of said shoulder formations at least one formation in said passage;

wherein, to insert the support arm, the gate element must be pushed against its bias to slidingly travel along said passage to expose said formation shoulder formations in said passage, whereby rotation of the support arm engages said at least one formation on the support arm with said shoulder formations in the passage for engagement by the support arm to retain the support arm in the socket, the gate element providing a positive force between the support arm and socket while it is so retained.

2. A support arm system according to claim 1, wherein the socket is fixed to a vertical surface, at least when in use.

3. A support arm system according to claim 2, wherein the surface includes an aperture to allow the socket to sit within the surface.

4. A support arm system according to claim 1, wherein the insertion opening and the cross-section of the support arm are circular.

5. A support arm system according to claim 4, wherein the outside of the housing is of a corresponding shape to said insertion opening and said element.

6. A support arm system according to claim 1, wherein the gate element is biased by a spring.

7. A support arm system according to claim 6, wherein the spring pushes against an internal rear surface of the socket housing.

8. A support arm system according to claim 1, wherein the formation on the support arm is a T-shaped protrusion projecting axially from an end of the support arm.

9. A support arm systems according to claim 8, wherein the T-shaped protrusion includes an axial post and two formations projecting laterally from the axial post, whereby the two formations fit within the internal circumference of the socket passage.

10. A support arm system according to claim 1, wherein the support arm is axially inserted into the socket before being rotated to engage the shoulder formations shoulders.

11. A support arm system according to claim 10, wherein said rotation is about 90°.

12. A support arm system according to claim 1, wherein the insertion opening leads to a passage in the housing along which said gate element travels and into which the support arm is inserted.

13. A support arm system according to claim 12, wherein projections on the gate clement arc complementary to channels in the passage walls, to assist in the alignment of the travel of the element.

14. A support arm system according to claim 1, wherein said positive force is provided by said bias that pushes the gate against the end of the support arm.

15. A support arm system according to claim 14, wherein said positive force must be overcome before the support arm can be disengaged from said shoulder formations in said passage for removal from the socket.

16. A support arm system according to claim 15, wherein said positive force is provided by the means biasing the gate element to said position at or in front of said shoulder formations, and is overcome by pushing the support arm further into said passage to push the gate element further back.

17. A support arm system according to claim 1, wherein to disengage the support arm from said shoulder formations in said passage for removal from the socket, the gate element is first pushed further back by the support arm.

18. A support arm system according to claim 1 wherein, when the support arm has been inserted into the socket and the formations engaged to retain the support arm therein, the support arm projects cantilever-fashion from the socket.

19. A support arm system according to claim 1, further including means on the support arm to retain items on the support arm.

20. A support arm system according to claim 1, further including means to mount said socket in an aperture of a panel.

21. A support arm system according to claim 1, wherein the gate includes a front surface and two rear flanges, whereby, when an arm is not inserted, the front surface aligns with the front surface of the shoulder formations and the rear flanges abut against the rear surface of the shoulder formations.

22. A support arm system, including:

a socket for attachment to a surface and a support arm, for removable insertion in the socket, the support arm having at least one formation, the socket including:

a housing having a front surface and an insertion opening in the front surface for receiving the support arm;

a formation including an undercut portion behind said insertion opening complementary to said at least one formation on the support arm and engageable therewith when the support arm is inserted into the socket for retaining the support arm in the socket; and a gate element moveable in said housing and having a periphery complementary to the insertion opening, said element being biased in a direction into said insertion opening from behind;

wherein said gate element is pushed by the support arm against its bias to allow insertion of the support arm into the socket and to allow said respective formations to be brought into engagement to retain the support arm in the socket, and wherein, when the support arm is not in the socket, said gate element provides a substantially flush surface with the front surface of the housing.

23. A support arm system according to claim 22, wherein the socket is fixed to a vertical surface, at least when in use.

24. A support arm system according to claim 23, wherein the surface includes an aperture to allow the socket to sit within the surface.

25. A support arm system according to claim 24, wherein a socket is provided on both sides of a vertical panel.

26. A support arm system according to claim 22, wherein the insertion opening and the gate element are rectangular.

27. A support arm system according to claim 22 or 26, wherein the outside of the housing is of a corresponding shape to said insertion opening and said element.

28. A support arm system according to claim 22 or 26, wherein the outside of the housing is of a differing shape to the insertion opening and said element.

29. A support arm system according to claim 22, wherein the gate element is biased by a spring.

30. A support arm system according to claim 29, wherein the spring pushes against an internal rear surface of the socket housing.

31. A support arm system according to claim 22, wherein the insertion opening leads to a passage in the housing along which said gate element travels and into which the support arm is inserted.

32. A support arm system according to claim 31, wherein projections on the gate element are complementary to channels in the passage walls, to assist in the alignment of the travel of the element.

33. A support arm system according to claim 22, wherein the at least one formation on the support arm is an upwardly extending projection.

34. A support arm system according to claim 33, wherein the support arm is presented at an upward angle such that the support arm pushes said gate element away from the front surface as the support arm is inserted into the insertion opening.

35. A support arm system according to claim 34, wherein the upwardly extending projection engages in the undercut portion and the support arm is lowered into a near horizontal orientation.

36. A support arm system according to 22, wherein said gate element is prevented, by a shoulder, from being pushed past a point, such that the lower part of the support arm end face cannot move further, to create the cantilever lock for the support arm.

37. A support arm system according to claim 36, wherein said bias pushes the gate element against the back of the projection to create a positive engagement between the socket and the support arm.

38. A support arm system according to claim 22, wherein a deformable lug is provided on the lower side of the insertion opening, and the gate element has a corresponding recess to allow it to move over said lug, and wherein the support arm further includes a second formation on its underside with which the lug engages to restrain upward movement of the support arm.

39. A support arm system according to claim 22, wherein, when the support arm has been inserted into the socket and the formations engaged to retain the support arm therein, the support arm projects cantilever-fashion from the socket.

40. A support arm system according to claim 22, further including means on the support arm to retain items on the support arm.

41. A support arm system according to claim 22, further including a connection device on the support arm for connecting other components to the support arm.

42. A support arm system according to claim 22, further including means to mount said socket in an aperture of a panel.

* * * * *

UNITED STATES PATENT AND TRADEMARK OFFICE

CERTIFICATE OF CORRECTION

PATENT NO. : 8,540,198 B2
APPLICATION NO. : 12/532053
DATED : September 24, 2013
INVENTOR(S) : Aydin Keyvanloo It is certified that error appears in the above-identified patent and that said Letters Patent is hereby corrected as shown below:

In the Claims
Please correct the Claims as follows:
Claim 1, Column 8, line 42, delete “at least one formation”
Claim 1, Column 8, line 48, delete “at least one formation”
Claim 1, Column 8, line 52, delete “formation”
Claim 1, Column 8, lines 55-56, delete “for engage-ment by the support arm”
Claim 10, Column 9, line 20, delete “shoulders”
Claim 15, Column 9, line 34, add -- 1 or -- before 14

Signed and Sealed this
Twenty-second Day of April, 2014

Michelle K. Lee

Michelle K. Lee
*Deputy Director of the United States Patent and Trademark Office*